US011488432B2

(12) United States Patent
Savage et al.

(10) Patent No.: US 11,488,432 B2
(45) Date of Patent: Nov. 1, 2022

(54) BULK ITEM ACCESS AND STORAGE SYSTEM

(71) Applicants: Benjamin V. Savage, Loveland, OH (US); Kent V. Savage, Morrow, OH (US)

(72) Inventors: Benjamin V. Savage, Loveland, OH (US); Kent V. Savage, Morrow, OH (US)

(73) Assignee: APEX INDUSTRIAL TECHNOLOGIES LLC, Mason, OH (US)

( * ) Notice: Subject to any disclaimer, the term of this patent is extended or adjusted under 35 U.S.C. 154(b) by 0 days.

(21) Appl. No.: 15/217,547

(22) Filed: Jul. 22, 2016

(65) Prior Publication Data

US 2017/0024944 A1 Jan. 26, 2017

Related U.S. Application Data

(60) Provisional application No. 62/195,817, filed on Jul. 23, 2015.

(51) Int. Cl.

| | |
|---|---|
| ***G07C 9/33*** | (2020.01) |
| ***A47G 29/14*** | (2006.01) |
| ***G07C 9/00*** | (2020.01) |
| ***E05G 1/00*** | (2006.01) |

(52) U.S. Cl.

CPC ..... *G07C 9/33* (2020.01); *A47G 29/14* (2013.01); *G07C 9/00912* (2013.01); *A47G 2029/142* (2013.01); *A47G 2029/149* (2013.01); *E05G 1/00* (2013.01); *G07C 9/00571* (2013.01)

(58) Field of Classification Search

CPC ... A47G 29/141; E05B 65/025; E05B 1/0092; E05B 47/0001; E05G 1/04; E05G 1/06; E05G 1/08; G06Q 30/0601

See application file for complete search history.

(56) References Cited

U.S. PATENT DOCUMENTS

| | | | | |
|---|---|---|---|---|
| 3,455,621 A | | 7/1969 | Kingsley | |
| 3,837,300 A | | 9/1974 | Karr | |
| 4,166,343 A | * | 9/1979 | O'Brian | E04B 1/3445 296/173 |
| 5,126,732 A | * | 6/1992 | Mardon | G07F 17/12 340/5.33 |
| 5,774,053 A | | 6/1998 | Porter | |

(Continued)

OTHER PUBLICATIONS

PCT, International Search Report and Written Opinion, International Application No. PCT/US2016/043529 (dated Oct. 6, 2016).

(Continued)

*Primary Examiner* — Brian E Miller

(74) *Attorney, Agent, or Firm* — Thompson Hine LLP

(57) ABSTRACT

An access and storage system including a generally enclosed storage compartment configured to be positioned on a ground surface such that a wheeled conveyance device carrying an item to be transferred is rollable directly into the storage compartment. The system includes a sensor system configured to track at least one of a placement, removal, presence or absence of the item or the wheeled conveyance relative to the storage compartment, and an access control system configured to control access to the storage compartment.

36 Claims, 9 Drawing Sheets

(56) References Cited

U.S. PATENT DOCUMENTS 5,941,405 A * 8/1999 Scales ..... B65D 88/522 220/1.5
5,946,660 A * 8/1999 McCarty ..... E05G 1/08 705/5
5,984,182 A 11/1999 Murrah et al.
6,056,177 A * 5/2000 Schneider ..... B60R 5/04 220/4.28
6,344,796 B1 * 2/2002 Ogilvie ..... A47G 29/141 340/5.2
6,426,699 B1 * 7/2002 Porter ..... A47F 10/00 221/2
6,499,817 B2 * 12/2002 Jermain ..... G07F 17/12 312/257.1
7,672,872 B2 * 3/2010 Shanton ..... A47F 5/11 340/5.92
7,809,470 B2 10/2010 Shoenfeld
7,896,243 B2 3/2011 Herskovitz
8,442,675 B2 5/2013 Wietgrefe
9,140,049 B2 * 9/2015 Suggs ..... A47B 81/005
9,322,207 B2 4/2016 Savage et al.
9,700,168 B1 * 7/2017 Evans ..... A47G 29/141
9,934,483 B1 * 4/2018 Sangani ..... G06Q 10/0837
2001/0045180 A1 * 11/2001 McCormick ..... A47G 29/10 109/53
2001/0045449 A1 * 11/2001 Shannon ..... A47G 29/141 232/19
2002/0014953 A1 2/2002 Stephens et al.
2002/0156645 A1 10/2002 Hansen
2002/0162883 A1 * 11/2002 Arvonio ..... G07B 17/00193 232/45
2004/0117307 A1 * 6/2004 Carlis ..... G06Q 20/105 705/41
2005/0237149 A1 10/2005 Loftin et al.
2006/0232381 A1 * 10/2006 Gauthier ..... E05G 1/08 340/5.73
2008/0122615 A1 * 5/2008 Shoenfeld ..... G08B 13/14 700/218
2009/0278426 A1 11/2009 Vinke
2011/0012490 A1 * 1/2011 Schwendemann ... A47B 46/005 312/326
2012/0158606 A1 6/2012 Moudy
2012/0200385 A1 8/2012 Savage et al.
2012/0203376 A1 * 8/2012 Savage ..... G06Q 10/087 700/214
2013/0261792 A1 * 10/2013 Gupta ..... G06Q 10/08 700/232
2015/0039458 A1 2/2015 Reid
2015/0102903 A1 * 4/2015 Wilkinson ..... G07C 9/00896 340/5.61
2015/0153218 A1 6/2015 Savage et al.
2015/0366377 A1 12/2015 Savage et al.
2016/0053514 A1 2/2016 Savage et al.
2016/0200517 A1 7/2016 Savage et al.
2016/0208543 A1 7/2016 Savage et al.
2017/0024944 A1 * 1/2017 Savage ..... G07C 9/33
2017/0053099 A1 * 2/2017 Coughlin ..... G07F 11/02
2017/0053230 A1 * 2/2017 D'Ambrosio ..... G06K 7/10366
2020/0143621 A1 * 5/2020 Reynolds ..... G06Q 10/087

OTHER PUBLICATIONS

EP, Search Report, European Application No. 16828600.3 (dated Feb. 13, 2019).
European Patent Office, Communication Pursuant to Article 94(3) EPC (Examination Report), European Patent Application No. 16828600.3, 7 pages, dated Nov. 22, 2021.

* cited by examiner

BULK ITEM ACCESS AND STORAGE SYSTEM

This application claims priority to U.S. Patent Application Ser. No. 62/195,817, filed on Jul. 23, 2015, the entire contents of which are hereby incorporated by reference.

The present application is directed to an access and storage system and method, and more particularly, to an access and storage system and method for relatively large items.

BACKGROUND

Retailers often provide or utilize websites, mobile applications, and other channels to facilitate ordering and/or purchasing goods from locations remote from a brick-and-mortar retail location. In order to take possession of the remotely ordered or purchased item, the customer generally must either wait for the purchased item to be delivered to the customer, or alternatively travel to the store during the store's business hours to retrieve the item. Some existing systems may allow relatively small packages to be picked up after business hours, but such systems can be difficult to utilize and may not accommodate larger items or larger quantities of items bundled together in a single order.

SUMMARY

In one embodiment, the present invention is an access and storage system which can accommodate larger items and the like. More particularly, in one embodiment the invention is an access and storage system including a generally enclosed storage compartment configured to be positioned on a ground surface such that a wheeled conveyance device carrying an item to be transferred is rollable directly into the storage compartment. The system includes a sensor system configured to track at least one of a placement, removal, presence or absence of the item or the wheeled conveyance relative to the storage compartment, and an access control system configured to control access to the storage compartment.

DETAILED DESCRIPTION

Figure 1:
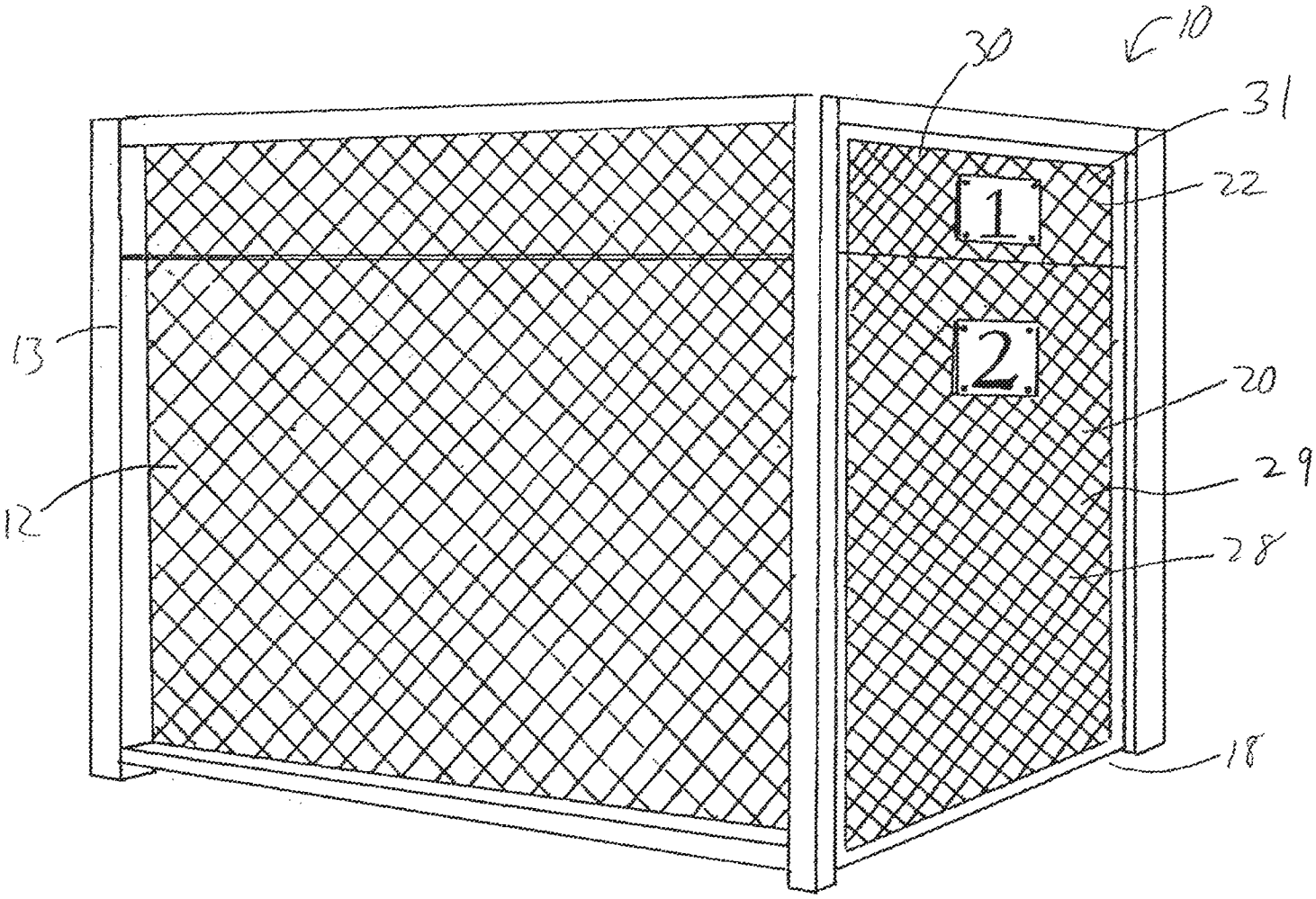
FIG. 1 is a front perspective view of one embodiment of an access and storage system with a single storage compartment.

FIGS. 1-7 illustrate certain embodiments of an access and storage system 10 which can be utilized in a variety of transactions for facilitating transfer of items, products or the like. For example in one case the access and storage system 10 can enable the transfer of any of a variety of items or products between two users or parties, in one case termed a "stocking" party and a "retrieving" party, in a secure manner that requires little or no direct or interpersonal interaction between the parties at the time of purchase and/or transfer. The stocking party may in one case be a seller, retailer, or picker or other employee at a retail or wholesale store preparing an order for pick up. The retrieving party may in one case be the customer who placed the order, purchased the items and/or takes possession of the items. The systems and methods disclosed herein may alternately be used to facilitate transfer of items in contexts other than sales, such as transfer of leased, rented, gifted, or borrowed property, for example to facilitate rental of equipment from a hardware store.

Referring now to FIGS. 1-4, in one embodiment, the access and storage system 10 includes one or more storage compartments or stalls 12 positioned at the same physical address at a retail store 15. Each storage compartment 12 can comprise or be defined by a generally enclosed framework 13 that can store therein one or a more items, products, supplies, tools, components, parts, ingredients, kits, consumables, or the like 14 (collectively termed "items" herein). The item 14 can take any of a wide variety of forms, depending upon the business of the stocking party and the setting in which the system 10/storage compartment 12 is utilized.

The storage compartment 12 may be relatively large, for example between at least about 2 feet and at least about 5 feet wide (but less than about 20 feet wide in one case), between at least about 3 feet and at least about 8 feet high (but less than about 10 feet high in one case), and between at least about 4 feet and at least about 15 feet deep (but less than about 20 feet deep in one case). In one embodiment the compartment 12 is about 3 feet wide, about 5-6 feet high, and about 9 feet deep, or larger. Accordingly, the storage compartment 12 can be large enough to receive therein a wheeled conveyance device 16, such as a flatbed cart, a grocery cart, a dolly, a lumber cart, a wheeled rack, a wheeled material handling device or the like, along with appropriately-sized items 14 stored in or on the wheeled conveyance device 16. The storage compartment 12 may also be sized such that a person having a height of at least about six feet in one case, or an otherwise average sized human adult, can entirely enter the compartment 12 to position the wheeled conveyance 16 and any items 14 thereon or therein into the storage compartment 12.

Figure 2:
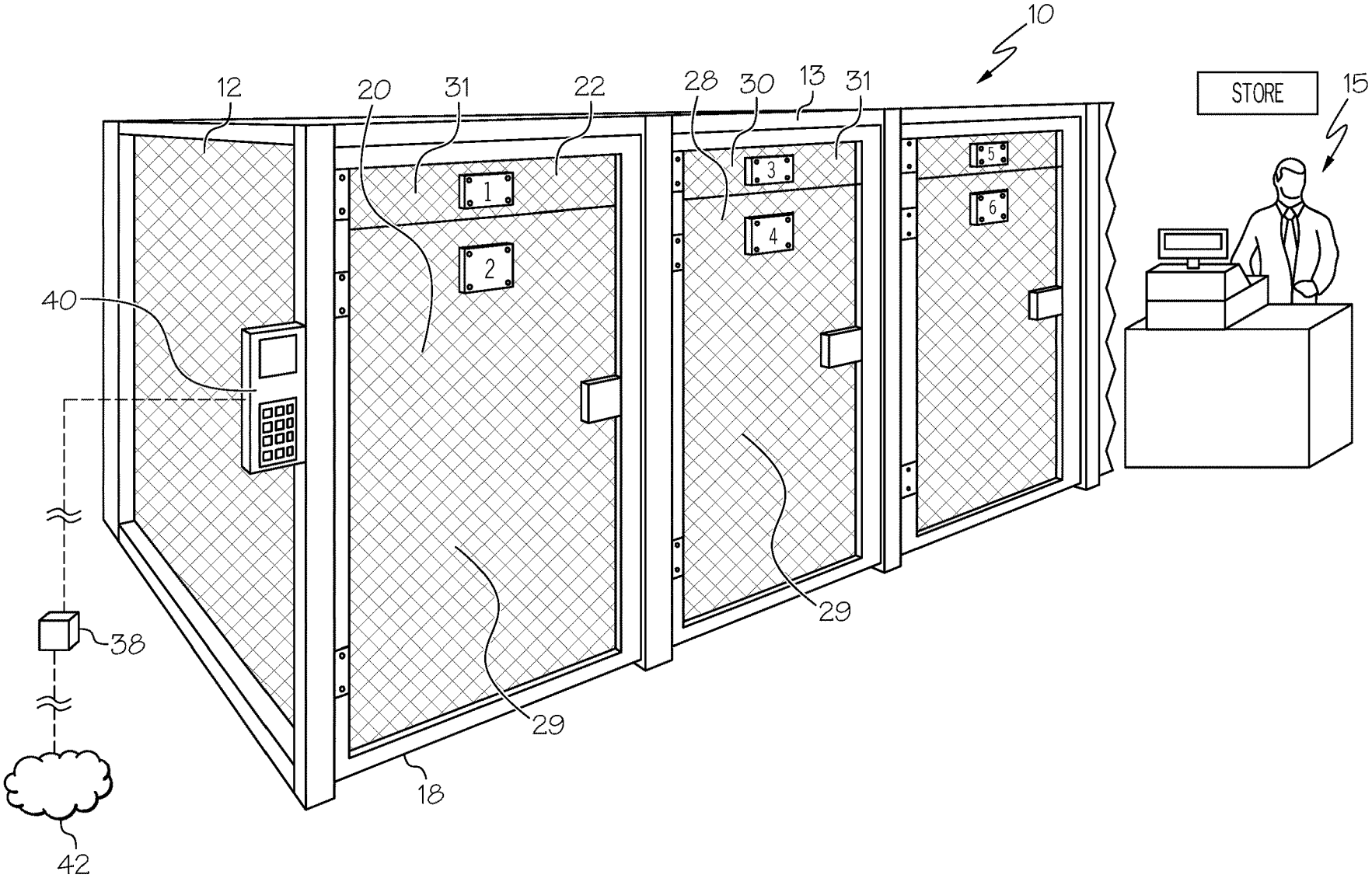
FIG. 2 is a front perspective view of an access and storage system with multiple storage compartments.

FIG. 1 shows a single storage compartment, and as shown in FIG. 2 in some embodiments the access and storage system 10 can include or take the form of a plurality of storage compartments 12. In this case different ones of the storage compartments 12 may have different dimensions, for example to accommodate differently-sized items 16, or alternatively each storage compartment 12 in the system 10 can have the same size and shape. In the depicted embodiments, the storage compartment 12 is shaped as a rectangular prism, but the storage compartment 12 may alternatively have any of a variety of other shapes.

The compartment 12 can have a base/bottom surface 18 that can be part of or defined by the framework 13, or may instead comprise the underlying floor or underlying support/ground surface such that the wheeled conveyance device 16 is rollable directly through an opening 29 and into the storage compartment 12. The base 18 may thus be at a same elevation as (e.g. within about one inch in one case, to avoid having to wheel a potentially heavy conveyance device 16 over relatively high obstructions/ramps) and/or substantially coplanar with the ground or underlying or immediately adjacent support/ground surface, upon which the storage component 12 is situated. In this case the door 20 may lack a frame component along its bottom surface, or if the door 20 does have a frame component along its bottom surface a ramp or the like may be provided on either side thereof, or the frame component may be recessed, to enable the wheeled conveyance 16 or items with wheels (such as appliances) to roll into the compartment 12. Thus the wheeled conveyance 16 can be positioned at a same elevation immediately before and after being wheeled into the compartment 12. On the other hand, if the compartment 12/framework 13 does not rest directly on the ground, the base 18 of the compartment 12 may be elevated from the ground or underlying support surface and a ramp, elevator, conveyor, or other device may be used to facilitate rolling the wheeled conveyance device 16 into the compartment 12.

The compartment 12 may be anchored to the ground or underlying support surface, or an adjacent wall or other structure. Thus the framework 13 can take the form of a five sided prism with an open bottom or a six sided prism with a bottom. However, the framework 13 can include less than five (or six) sides when positioned adjacent to fixed walls, structures or the like. Moreover, while the framework 13 is illustrated in the form of an open mesh framework, which can allow air circulation and visibility, the framework 13 can take the form of more solid or substantial walls for improved security.

Each compartment 12 may include or be divided into a main portion 20 and a sub-compartment 22. In some embodiments, the compartment 12 may include more than one sub-compartment 22. The main portion 20 can be substantially larger than the sub-compartment 22, and the sub-compartment 22 may be positioned above or to one side of the main portion 20. For example, in one embodiment the compartment 12 is about six feet high in total, where the main portion 20 is about five feet high and the sub-compartment 22 is about one foot high, positioned above the main portion 20 and extending the entire width and depth thereof. Accordingly, when the sub-compartment 22 is positioned at the top of the compartment 12, and positioned entirely above the door 28, the sub-compartment 22 reduces interference with access to the main portion 20 by the wheeled conveyance device 16. The sub-compartment 22 may be a permanent shelf, or, as discussed in more detail below, the sub-compartment 22 may include or be defined by a storage shelf 24 that may be collapsed to increase the size of the main portion 20 to accommodate larger items that would otherwise not fit into the storage compartment 12 due to interference with the sub-compartment 22.

Each compartment 12 may include a first or main door 28 corresponding to the main portion 20 and a second or sub-compartment door 30 corresponding to the sub-compartment 22 to control access to the compartment 12. The doors 28, 30 may each be pivotally/hingedly mounted to the framework 13 and movable independently of each other and cover/close associated access openings 29, 31. The access opening 29 may be sized and configured to allow an average-sized adult to pass or walk therethrough in a fully or substantially upright manner to access/enter the main portion 20/storage compartment 12/framework 13. In addition the access opening 29, or at least a bottom portion thereof, may have a width of at least about two feet in one case, or at least about three feet in another case, to allow a sufficiently-sized wheeled conveyance 16 to pass therethrough.

The doors 28, 30, may be physically coupleable to optionally move together as a unit to access the main portion 20 and the sub-compartment 22 simultaneously (or to access an enlarged main portion 20 in an embodiment with a collapsible storage shelf 24 in the collapsed position). In one embodiment, the compartment 12 may include further openings and/or doors at a rear location thereof (not shown), opposite the doors 28, 30, to provide a secondary access route to the interior of the compartment 12, for example to provide additional stocking options to the stocking party. Moreover, in some embodiments only a single larger door 28 may be utilized, which covers both openings 29, 31 and thereby controls access to both the main portion 20 and the sub-compartment 22, as shown for example in FIG. 6A.

The access and storage system 10 can be configured to selectively control access to the compartment 12, though access to the compartment 12 need not necessarily be so controlled. In one embodiment, access may selectively granted to the main portion 20 and/or sub-compartment 22 of a particular compartment 12, but access may be denied to the other portion of the compartment 12, by selectively locking/unlocking only one of the first door 28 or the second door 30 for that compartment 12. Access to the compartment 12 through one or both of the doors 28, 30 may be controlled with a manual lock, or alternately through a controller 38 as discussed in more detail below.

Figure 6B:
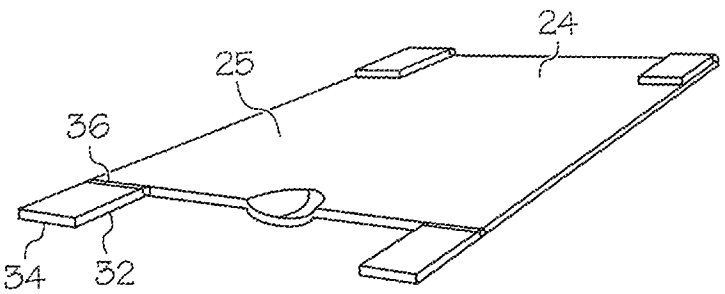
FIG. 6B shows the shelf of FIG. 6A in a collapsed position.
Figure 6A:
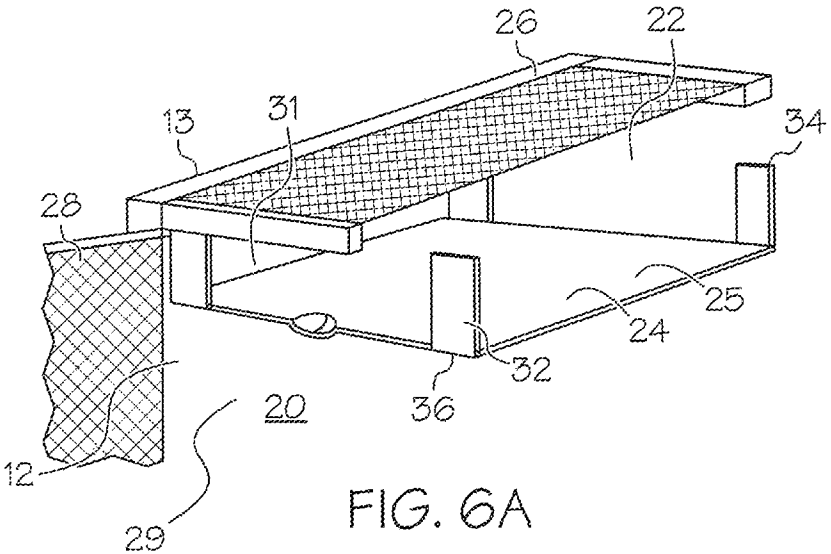
FIG. 6A is a partial perspective view of a compartment with a shelf in an expanded position.
Figure 6C:
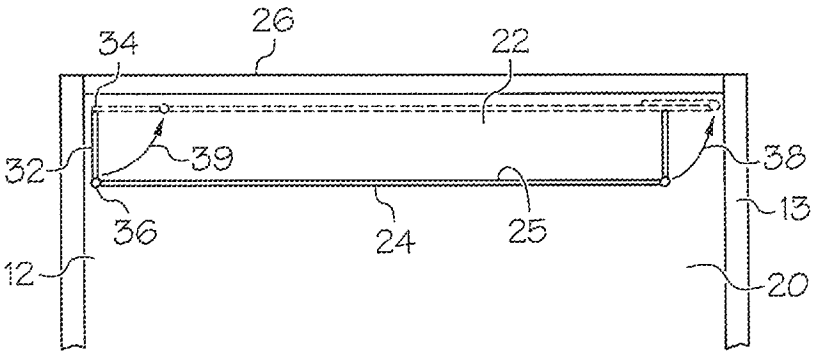
FIG. 6C is a side view of the shelf of FIG. 6A showing how the shelf can move from the expanded position to the collapsed position.
Figure 7B:
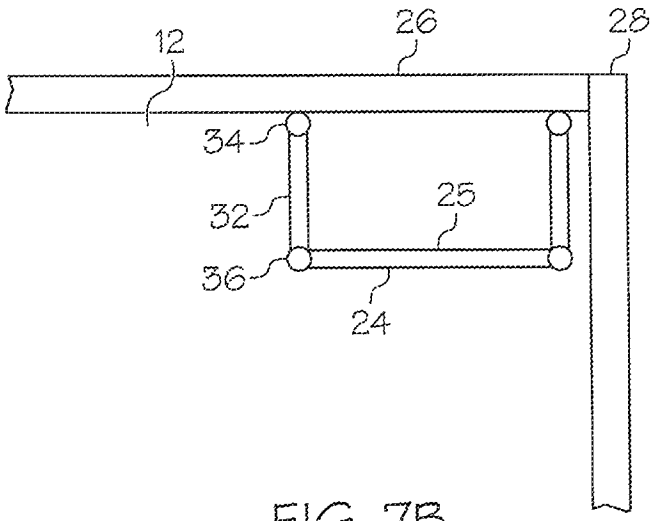
FIG. 7B is a side view of the shelf of FIG. 7A.
Figure 7C:
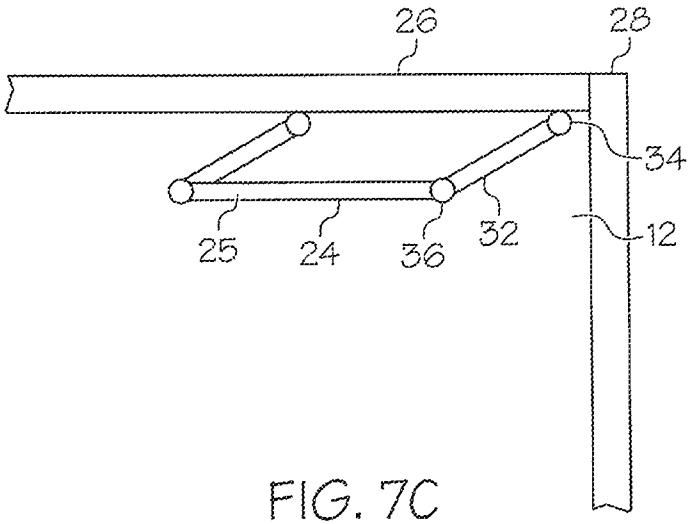
FIG. 7C is a side view of the shelf of FIG. 7A in a collapsed position.
Figure 7A:
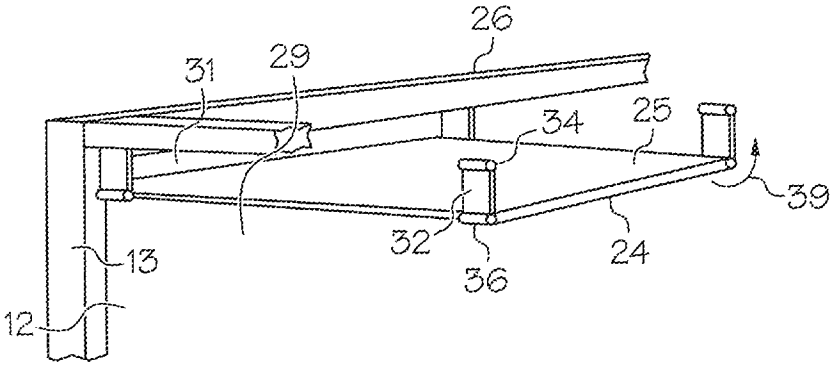
FIG. 7A is a partial perspective view of a compartment with a shelf in an expanded position.

Referring now to FIGS. 6A-C and 7A-C, the sub-compartment 22 may include or be defined by a collapsible shelf 24 movable between an expanded position where the shelf 24 is deployed for use and a compact or collapsed position where the shelf 24 is stowed. When the shelf 24 is in its collapsed position, substantially the entire height of the storage component 12 is defined by the main compartment 20 and available to accommodate a single relatively large order. FIGS. 6A-6C depict an embodiment where the shelf 24, when in its expanded position has a width (in the left-to-right direction) that extends substantially the entirety of the width of the compartment 12, and a depth (in the front-to-back direction) that extends the majority of the depth of the compartment 12, for example at least about 50%, 75%, 90%, or 95% of the width and/or depth of the compartment 12. FIGS. 7A-C depict an embodiment where the shelf 24 is more shallow than that of FIGS. 6A-C, having a depth that is less than about 50%, 25%, or 10% of the full depth of the compartment 12 in which it is installed.

In the embodiments of FIGS. 6A-C and 7A-C, the collapsible shelf 24 is coupled to the ceiling/upper surface 26 of the storage compartment 12/framework 13 by a plurality of suspended supports 32 coupled to the shelf 24 by a plurality of first or upper hinges 34 and second or lower hinges 36, respectively. The upper hinges 34 pivotally couple the supports 32 to the ceiling 26 of the storage component 12 and the lower hinges 36 pivotally couple the supports 32 to the platform 25 of the generally flat/planar collapsible shelf 24.

The access and storage system 10 may include a locking mechanism (not shown) to releasably secure the collapsible shelf 24 in the each of the expanded and collapsed positions.

In the expanded position, the shelf 24 is suspended from the ceiling 26 with the platform 25 of the shelf 24 substantially parallel with the ceiling 26 and the supports 32 substantially perpendicular thereto, thereby defining the sub-compartment 22. In the collapsed position, the collapsible shelf 24 is positioned with the platform 25 thereof immediately adjacent to the ceiling 26 and parallel thereto. The collapsible shelf 24 is movable between the expanded position and the collapsed position by pivoting the collapsible shelf 24 via the network of hinges 34, 36 in accordance with the movements indicated by arrows 39 in FIG. 6C and FIG. 7A to substantially flatten the collapsible shelf 24 against the ceiling 26 of the storage component 12.

In alternative embodiments, the collapsible shelf 24 may include alternative or additional structures for transitioning between the expanded and collapsed positions. For example, the shelf 24 may be hingedly coupled to a side wall of the storage compartment 12, and the shelf 24 may be positioned adjacent to and substantially flat against the side wall when in the collapsed position. The shelf 24 could then be pivoted to such that its platform 25 is positioned substantially perpendicular to the side wall to which it is attached and secured to the opposite side wall and/or the ceiling 26 when in the expanded position. Further alternatively, the collapsible shelf 24 may be entirely removable from the storage component 12. The collapsible shelf 24 may include additional panels along the sides and/or back thereof to fully contain items thereon, and such additional panels may be attached via hinges or other flexible structures to facilitate folding of the shelf 24 to and from the collapsed position.

Figure 3:
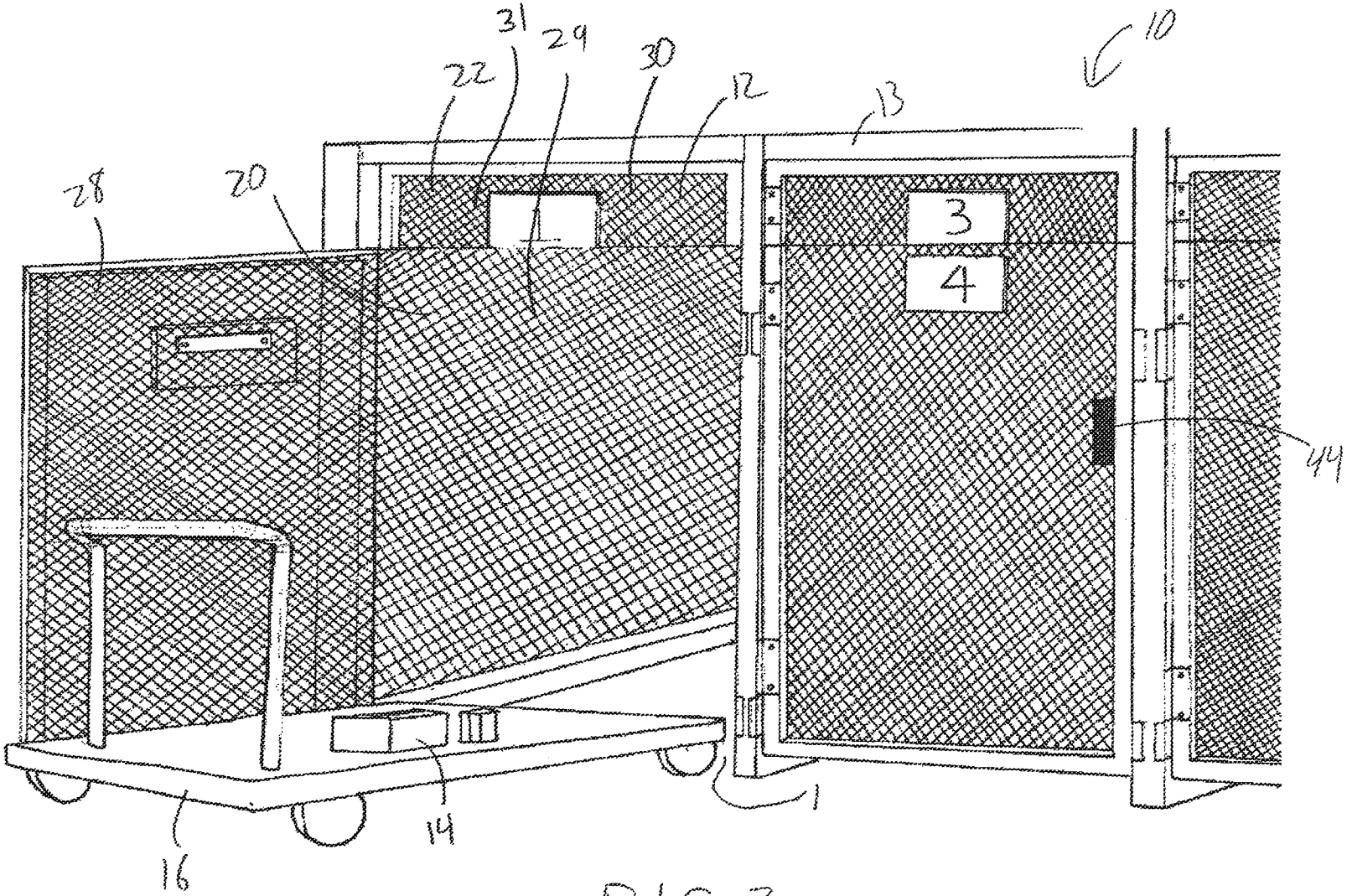
FIG. 3 is a front perspective view of an access storage system shown in conjunction with a cart.
Figure 4:
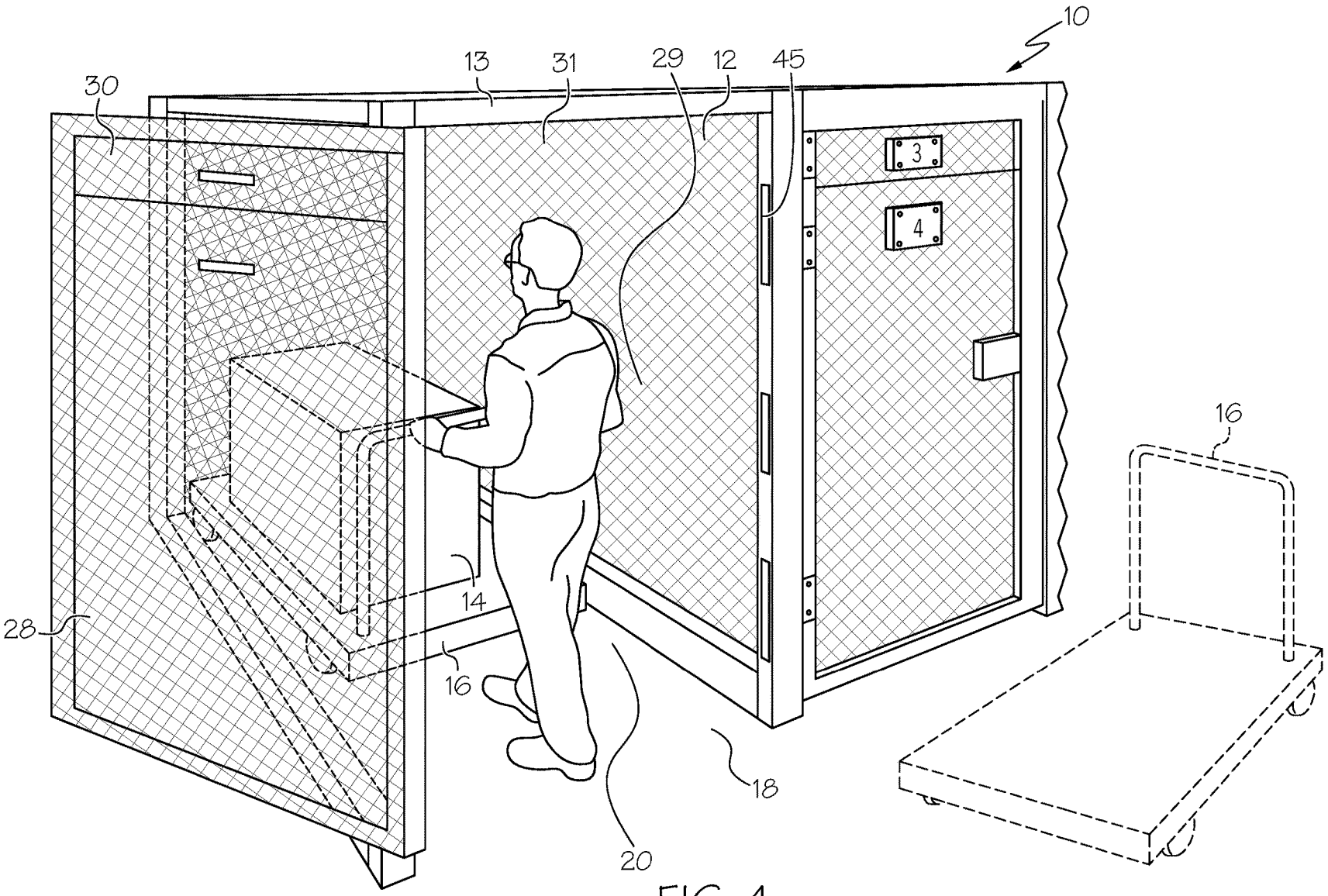
FIG. 4 is a front perspective view of the access and storage system of FIG. 3, with the doors in an open position.

As shown in FIGS. 2-4, the access and storage system 10 can include multiple storage compartments 12/framework 13 arranged side-by-side in a row or even in an array with ramps provided to the upper compartment 12. Each storage compartment 12 can have the same characteristics and qualities of the storage compartment 12 described above. The access and storage system 10 can be configured to selectively control access to all or certain compartments 12, or certain main portions 20 and/or sub-compartments 22 thereof. In particular, the access and storage system 10 may include or be associated with a controller 38 (FIG. 2) which a user can interact with to gain access to all or certain portions of the storage compartments 12. The controller 38 may take the form of a processor, CPU, computer or the like, and may include or be operatively coupled to sensors 44 to detect and/or track the presence and/or absence and/or movement of the wheeled conveyance device 16 and/or any items 14 within the main portion 20 and/or sub-compartment 22 of each storage compartment 12.

Figure 5:
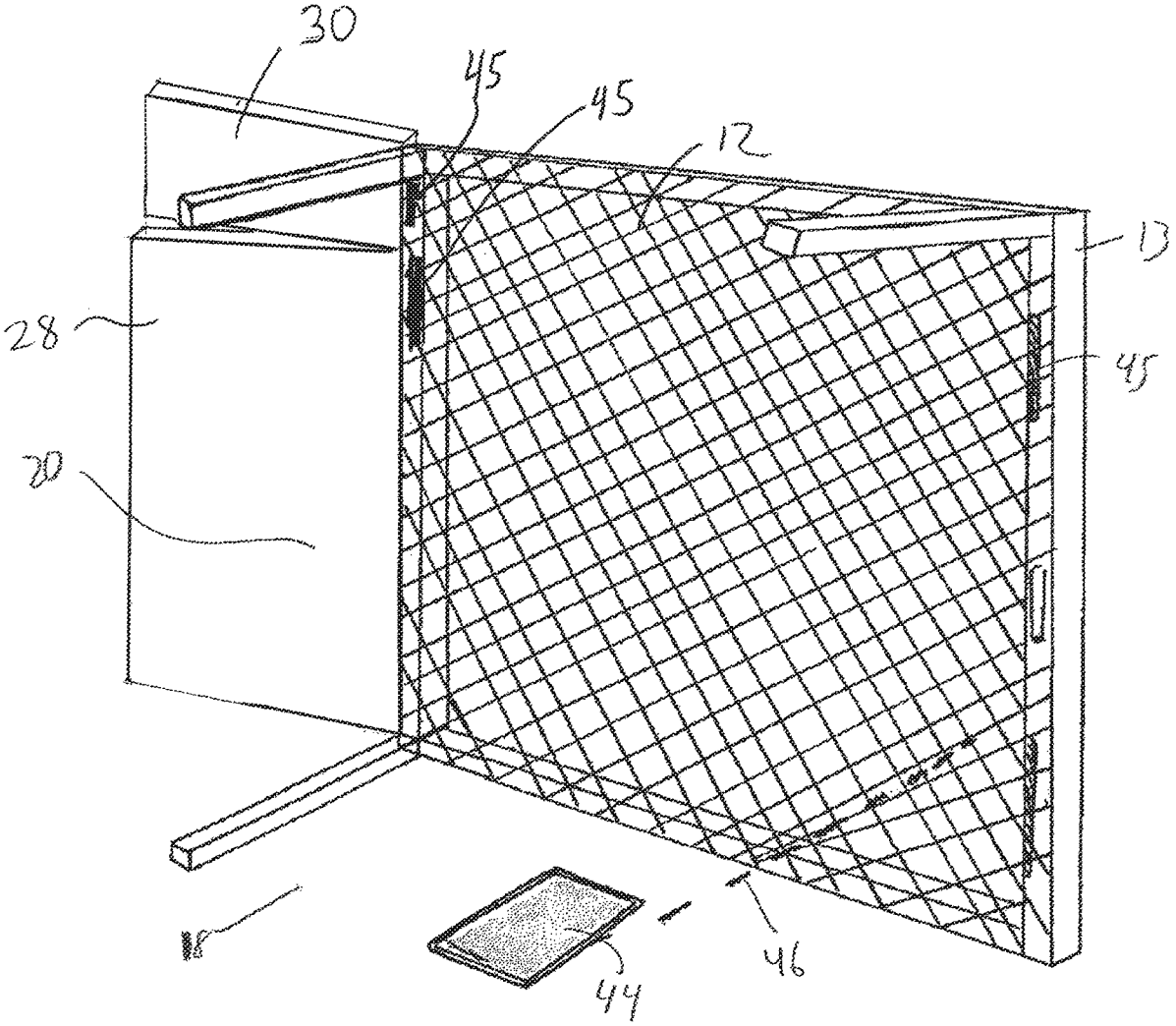
FIG. 5 is a partial interior view of a compartment with a ground sensor.

Each storage compartment 12/framework 13 may include one or more sensors 44 therein or associated therewith, and each sensor 44 can take any of a wide variety of forms. In one case, as shown in FIG. 5, the sensor 44 is a break beam sensor and/or weight sensor positioned at the base or floor 18 of the main portion 20 of the compartment 12 such that when a wheeled conveyance device 16 or item 14 is positioned in or removed from the storage compartment 12, the break beam 46 is broken or completed, triggering the sensor 44. In another case, the sensor 44 is a light/dark switch which detects the sufficient presence and/or absence of light. However, each of the sensors 44 can take any of a wide variety of forms, including but not limited to pressure or force sensors, weight sensors, optical or line-of-sight sensors, detectors based on mechanical forces, membrane switches/sensors, magnetic switches/sensors, light or electromagnetic radiation (visible, infrared or otherwise) sensors, contact sensors, photoelectric sensors, ultrasonic sensors, piezoelectric sensors, piezoresistive sensors, accelerometers, motion sensors, tilt sensors, proximity sensors, electric field sensors and other sensing devices.

In addition to sensors for confirming presence or absence of items within the compartment 12, the system 10 may further include a sensor 45 or sensors 45 to monitor whether the doors 28, 30 are open or closed, and the controller 38 may track such activity. The sensor(s) 44, 45 may be positioned at any appropriate location within, on, or outside the compartment 12, the doors 28, 30, and the like, as necessary for the particular type of sensor to properly function for its intended purpose. In one embodiment, sensors or tags such as RFID tags are also included on or in the wheeled conveyance device 16 and/or any items 14 positioned in the storage compartment 12 and the sensor 44 can take the form of a RFID sensor, providing further tracking capability for items 14.

The controller 38 may be operably coupled to the system 10, including the various sensors 44, 45 to track ingress or egress of items 14 to or from the compartment 12, and/or to selectively lock or unlock the doors 28, 30 to control access to the interior of the compartment 12 for stocking or retrieval of items 14 by authorized individuals. The controller 38 may include or be operatively coupled to a user interface or identifying device 40 in the form of a keypad, touch screen, keyboard, mouse, track ball, audio input device, barcode scanner, qr code reader, card reader, biometric identifying device, or the like, to identify and/or authenticate users. The controller 38 may be operatively connected to a remote system or server 42 to provide interne connectivity access, for example to enable communication between web-based order management software systems and locally-based software systems for managing operation access and tracking functionality of the storage system 10. In one case each compartment 12 may include its own associated user interface 40. Alternatively, a single user interface 40 may be associated with multiple compartments 12, and in one case such compartments 12 that are nearby and within a line of sight of a user using the user interface.

Accordingly, the controller 38 may be used as an access control system to control and monitor stocking and retrieval of items 14 to and from the main portion 20 and/or sub-compartment 22 of specific storage compartments 12. The controller 38 may also be configured to interact with remote systems to communicate stocking and retrieval requirements and permissions as defined by incoming customer orders and pre-programmed software control parameters. In some cases, a separate user interface 40 may not be needed and a user can interact with the controller 38 remotely such as by using a mobile device, phone, tablet, computer, etc. which can operate as the user interface 40.

The various components of the access and storage system 10 may be pre-fabricated and shipped as a completed unit to a site for use/installation, or, alternatively the system 10 may be wholly or partially manufactured on site from locally-sourced components. The system 10 may be installed and used indoors or outdoors. If installed outdoors, the system 10 may include weather-resistant components, and/or may be installed within a weather-resistant enclosure. The system 10 may include or be used in conjunction with security devices such as cameras, security systems, monitoring systems, etc. to provide added security or proof of drop off/delivery/pickup, or to track access to the compartment 12. Alternatively, the system 10 may be positioned in an area monitored by a pre-existing security system.

Figure 8:
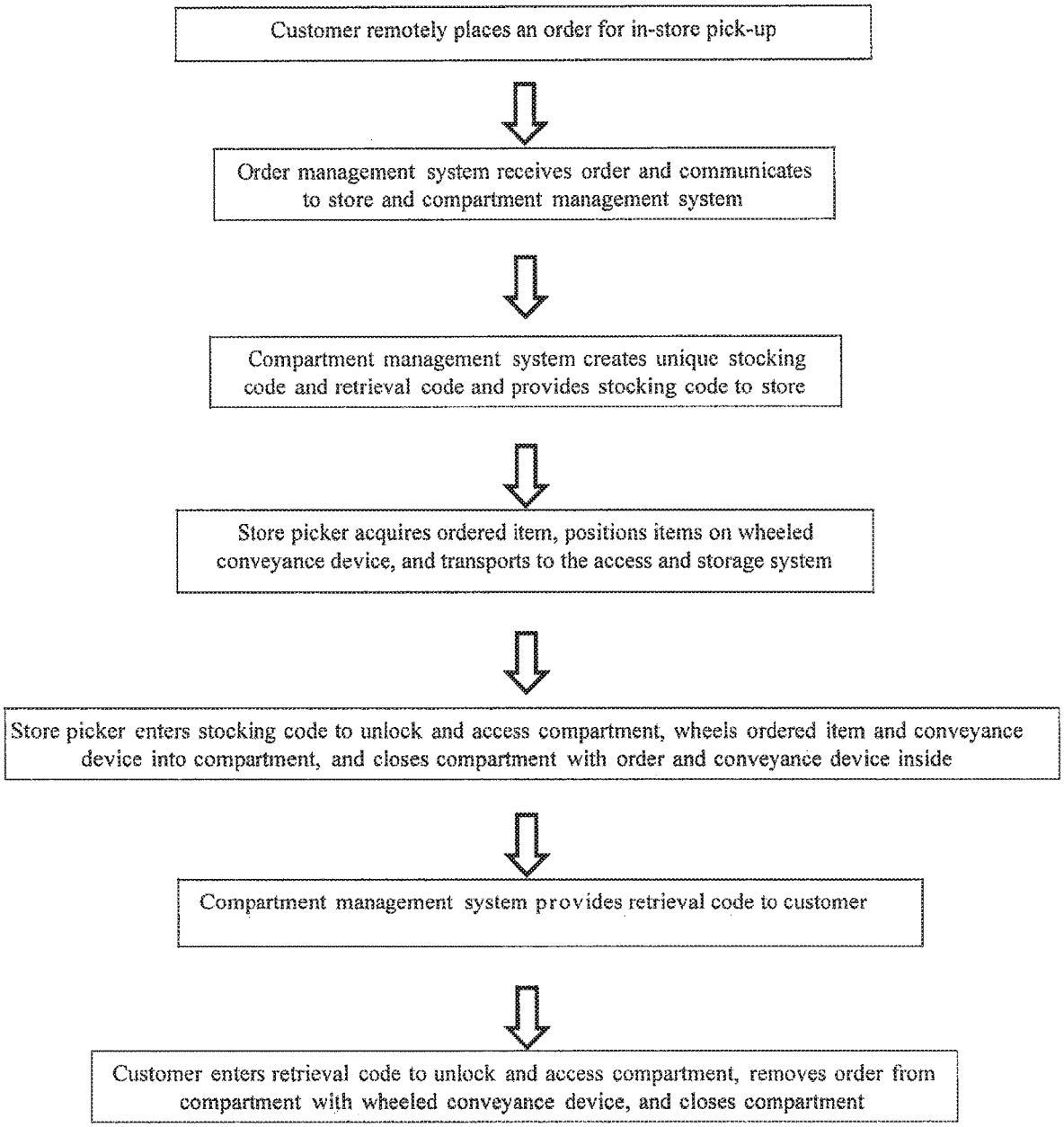
FIG. 8 is a flow chart diagram showing a first workflow for use of an access and storage system.

Referring now to FIG. 8, one embodiment of a workflow of a method for use of the access and storage system 10 will be described in the exemplary context of the sale of a lawnmower from a hardware store that is packaged in a large box. Of course, the system 10 can be used for delivery/pickup of any of a wide variety of items in a variety of settings. In the illustrative example, the access and storage system 10 is positioned at the site of the hardware store, or at an alternate pick-up location such as a warehouse or third party site.

As an initial step of this method, the customer places an order for the lawnmower from the hardware store/vendor, for example through an internet e-commerce website, a mobile phone or tablet application, a phone call, a fax order, or any of a variety of other remote or on-site purchasing channels, indicating the customer's intention and desire to pick up the lawnmower at the site where the access and storage system 10 is installed. Payment for the lawnmower/item 14 may be made at this time and the customer can request or be informed the order can be picked up via the access and storage system. In some cases the user may be provided with a unique retrieval code at this time. The order can be automatically or manually inputted into an order management system installed in a computer system, or a web-based system, which is operatively connected with compartment management software installed in the controller 38 of the access and storage system 10. The order management system software and the compartment management software can, in one embodiment, be installed or accessed through one or more computers or controllers or one or more networks of computers and/or controllers.

After the order is input in the order management system, the order management system can notify store personnel that the order will be delivered/retrieved via the access and storage system 10. The order management system also communicates the order information to the compartment management system. Alternately, store personnel may communicate the order information to the compartment management system as a separate step. The compartment management system creates a stocking code (for use by the store or stocking entity/individual) and a retrieval code (or a supplemental code, for use by the customer/purchaser) for the order, where the stocking code and the retrieval code can be different from each other. The stocking and retrieval codes may each be unique and single use, meaning that subsequent orders will have different codes. For maximum security, the entity/individual who receives the stocking code should not have access to the retrieval code and should not know the identity of the customer. Otherwise, the stocking entity/individual would have means to provide access to the stocked item to an unaffiliated third party, or to include extra items in the compartment 12 that the customer is not entitled to receive. One or both of the stocking code or the retrieval code may be a bar code, qr code, or other identifier capable of being entered or scanned into the user interface 40.

The compartment management system then provides the stocking code to a store picker assigned to stock the compartment 12 of the access and storage system 10 with the lawnmower/item 14. The compartment management system may at this time also inform the store picker of the identity/location of the specific compartment 12 to be used. In one embodiment, the compartment management system automatically assigns the compartment 12 (and/or main portion 20 and/or sub-compartment 22 thereof) into which the item 14 will be stocked, based on the size and/or shape of the item 14 and the available compartments 12, such that items 14 can be assigned to size-appropriate compartments 12 and/or sub-compartments 22. Alternately, store personnel may manually select the appropriate compartment 12 or portion thereof.

A store picker then picks the item 14 from its storage location within the store or warehouse location, and can position the item 14 on the wheeled conveyance device 16. The store picker then transports the wheeled conveyance device 16 with the item 14 to the access and storage system 10. The store picker accesses the user interface 40 and enters the stocking code provided by the compartment management system. The controller 38 then allows or denies access to the applicable compartment 12 based on whether the store picker has entered the correct stocking code. If the user interface 40 is associated with multiple compartments 12, the identity/location of the specific compartment 12 may be provided as an output of the user interface 40.

Upon confirmation of the stocking code by the controller 38, the controller 38 unlocks, automatically opens, and/or otherwise provides access to the appropriate door 28, 30 (which may be sensed by the door sensor 45) to facilitate stocking of the lawnmower/item 14 in the compartment 12. The store picker then wheels the lawnmower/item 14 into the storage compartment 12, which can trigger at least one sensor 44 to indicate that the item 14 is properly positioned within the storage compartment 12. In one embodiment, the store picker leaves the wheeled conveyance device 16 in the storage component 12 along with the item 14 (e.g., lawnmower) positioned thereon. The store picker then closes the door 28, 30, which the controller 38 may sense via a sensor 45. In one case the sensor 44 can be utilized to ensure one or more qualities of the item 14 (i.e., weight, outer dimensions, etc.) match the qualities expected for the item 14, and send a notification if the measured qualities are outside and/or inside range. Once the door 28, 30 is closed and optionally after the item 14 is confirmed to be within the storage component 12 (e.g., via the sensor 44), the stocking code expires and can no longer be used to access the contents of the storage compartment 12. The item 14, positioned on the wheeled convenience device 16, can thus be left in storage compartment 12.

Once the item 14 is stocked, the compartment management system can notify the customer that the order is ready for retrieval and send the retrieval code to the customer (if not already sent), for example via email, text message, audio or visual signal, through interaction with a vibrating signal device, or any of a variety of other signaling methods. The compartment management system may additionally notify the customer which compartment 12 contains the customer's purchased item.

Upon arrival at the access and storage system 10, the customer inputs the retrieval code (or scans the barcode, etc.) into the user interface 40. In some cases, if the customer has not already paid for the item 14, the customer can pay via the user interface 40 such as by credit card, pay pal payment system, or via a user's mobile device, and the retrieval code is then provided. After the customer enters the retrieval code the controller 38 then allows or denies access to the applicable compartment 12 based on whether the customer has entered the correct retrieval code. If the retrieval code as verified by the controller 38, the controller unlocks and/or automatically opens the appropriate door 28, 30 to facilitate removal of the item 14 and may identify or provide the location of the appropriate compartment 12. The customer may conveniently use the wheeled conveyance device 16 upon which the lawnmower or item 14 is already positioned to transport the item 14 out of the compartment 12. Opening/closing of the doors 28/30 may be sensed by the sensor 45 and removal of the item 14 may be sensed by the sensor 44.

Figure 9:
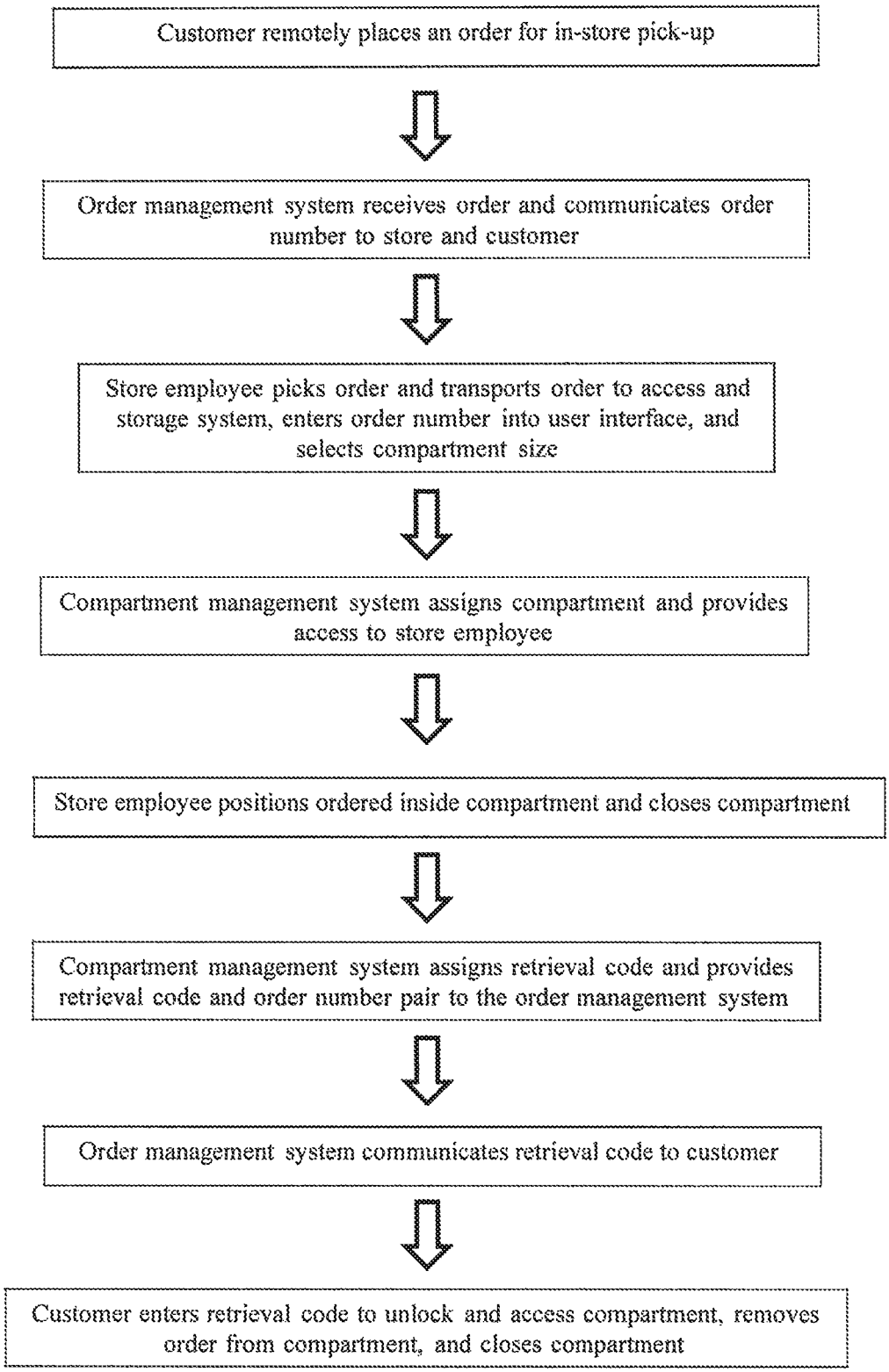
FIG. 9 is a flow chart diagram showing a second workflow of the use of an access and storage system.

After removal of the item 14, the customer shuts the door 28, 30 which the controller 38 may sense via sensors 45 and/or the door 28, 30 can be automatically closed. Once the door 28, 30 is closed and the item 14 is confirmed to have been removed from the storage component 12 (e.g., via the sensor 44), the retrieval code expires and can no longer be used to access the contents of the storage component 12. Accordingly, the component 12 is again available for use for another order with new stocking and retrieval codes. In some cases the retrieval code can allow the customer access to a limited area (i.e., behind a typically locked door) in which the system 10 is located. If the order is not retrieved by the customer within a predetermined period of time (for example within an hour, or within a day or within three days) the compartment management system/controller 30 may send a reminder to the customer, Referring now to FIG. 9, another embodiment of a workflow method for use of the access and storage system 10 will be described, again in the exemplary context of the sale of a lawnmower from a hardware store that is packaged in a relatively large box. In this case, a customer can place a purchase order for the lawnmower/item 14, for example through an order management system, as before. The order is communicated to a known store personnel such as a store picker, along with the customer's order number.

The store picker picks the item 14 from its storage location within the store, and can position the item 14 on the wheeled conveyance device 16. The store picker can then transport the item 14 with the wheeled conveyance device 16 to the access and storage system 10. The store picker accesses the user interface 40 and enters the order number via keypad, bar code, qr code, or other suitable entry method. The store picker can also select a suitable compartment size (e.g., full storage compartment 12, main part 20, or sub-compartment 22). The compartment management system can then assign the order to a specific compartment 12 (or portion thereof). The controller 38 unlocks, automatically opens, and/or otherwise provides access via the appropriate door 28, 30 to the assigned compartment 12 to facilitate stocking of the item 14. The store picker then transports the item 14 into the storage compartment 12, which can trigger at least one sensor 44 to indicate that the item 14 is positioned within the storage compartment 12. The store picker then closes the door 28, 30, which the controller 38 may sense via sensors 45.

Once the lawnmower or other item 14 is stocked, or at the same time that access is granted to the picker, the compartment management system generates a retrieval code and provides it to the order management system that the customer used to place the order, matched with the order number. The order management system then communicates the retrieval code to the customer to indicate that the item 14 is ready for pick up, in essentially the same manner earlier discussed with respect to the embodiment of FIG. 8.

The access and storage system 10 thus facilitates efficient self-service customer retrieval of items, such as remotely-sold items, including relatively large items and groups of products that require wheeled transports to effectively or efficiently transport the items. A seller can remotely accept a plurality of orders and/or payment for such orders from a plurality of customers, and then prepare each order for customer pickup in a secure manner without the need for interpersonal interaction with the customer to locate and retrieve each customer's particular order upon the customer's arrival at a store location. The system 10 thus both organizes and segregates each order into a storage compartment 12, and also provides security to ensure that customers only retrieve the order(s) for which they have paid, because each storage compartment 12 requires a different and unique retrieval code for access. This system and method saves time and improves efficiency for the remote customer, who can, in some embodiments, self-retrieve purchased products upon arrival at the sale site, as well as for store personnel who can pick products into a wheeled device 14 and directly position the wheeled device into the compartment 12 without the need to unload the product.

The disclosed system 10 allows customer orders to be picked by the seller, positioned on a cart or other wheeled device 14 containing the entire order, and then rolled directly into a secure compartment 12 for retrieval by the customer. The seller does not need to remove the items from the cart 14 prior to retrieval by the customer and the customer can directly roll the cart to their vehicle for loading, which improves efficiency. A seller can also pick up an order outside of the store's normal business hours.

The disclosed system 10 also provides a method of tracking the status of items in a compartment 12 with sensors 44 that monitor contents of the compartment 12. The system 10 may not rely entirely on monitoring whether a compartment door 28, 30 has been opened or closed to infer contents of the compartment 12 and can track storage and removal accordingly. Thus, the disclosed system 10 provides enhanced confirmation capabilities to confirm actual placement and/or retrieval of items from the compartment 12.

It should be appreciated that the principles of the access and storage system 10 and use thereof may be implemented in a variety of manners that depart in certain ways from the embodiments expressly depicted herein, without departing from the scope of the invention. Although the invention is shown and described with respect to certain embodiments, it should be clear that modifications will occur to those skilled in the art upon reading and understanding the specification, and the present invention includes all such modifications.

What is claimed is:

1. An access and storage system comprising:

a generally enclosed storage compartment configured to be directly or indirectly positioned on a ground surface, the storage compartment having an opening sized and positioned such that a wheeled conveyance device carrying an item to be dispensed is rollable from the ground surface through said opening and into said storage compartment;

a sensor system configured to detect at least one of a presence of said item in said compartment, absence of said item from said compartment, removal of said item from said compartment, or placement of said item in said compartment; and an access control system configured to control access to said storage compartment, wherein said storage compartment includes a collapsible storage shelf coupled to a ceiling of said storage compartment, wherein said collapsible storage shelf, when collapsed, defines or is positioned immediately adjacent to the ceiling of said storage compartment and is oriented parallel to the ceiling, and when expanded defines a sub-compartment within said storage compartment.

2. The system of claim 1, further comprising:

a plurality of generally enclosed storage compartments configured to be directly or indirectly positioned on a ground surface, each storage compartment having an opening sized and positioned such that a wheeled conveyance device carrying an item to be dispensed is rollable from the ground surface through said opening and into said storage compartment, wherein each storage compartment is sized such that a person and said wheeled conveyance can be simultaneously entirely positioned in said compartment so that said person can place said wheeled conveyance and said item into said storage compartment;

wherein the sensor system is configured to detect, with respect to each compartment, at least one of a presence of said item in said compartment, absence of said item from said compartment, removal of said item from said compartment, or placement of said item in said compartment; and wherein the access control system is configured to control access to each storage compartment.

3. The system of claim 2 wherein said plurality of storage compartments are positioned at the same physical address, and wherein the system further comprises a processor configured to provide a notification to a user when said sensor system provides an output processed by said processor that said item to be dispensed is positioned in or present in one of said storage compartments, and wherein the processor is configured to provide information to said user relating to which of said storage compartments the item to be dispensed is positioned.

4. The system of claim 2 wherein each storage compartment is positioned on the ground surface such that said wheeled conveyance device carrying said item to be dispensed is rollable directly into each storage compartment.

5. The system of claim 1, further comprising a processor for receiving an order relating to a purchase of said item, and responsive thereto issuing a code to a purchaser, which purchaser is positioned remotely from the storage compartment, which the purchaser can provide to said access control system to thereby access said storage compartment.

6. The system of claim 5 wherein said processor is configured to issue a supplemental code which a supplemental user can provide to said access control system to thereby access said storage compartment.

7. The system of claim 6 wherein said code and said supplemental code are different.

8. The system of claim 1 wherein said system further includes a first door configured to control access to said sub-compartment when said collapsible storage shelf is expanded and a second door configured to control access to a remainder of said compartment when said collapsible storage shelf is expanded.

9. The system of claim 8 wherein said first door and said second door are openable and closable independently of each other.

10. The system of claim 1 further comprising a processor for receiving an order relating to a purchase of said item and responsive thereto issuing a code which a purchaser can provide to said access control system to thereby access of said storage compartment, and wherein the processor is further configured to provide an identifier relating to the storage compartment.

11. A method for providing access to an item comprising:

receiving an order for an item;

placing said item in a generally enclosed storage compartment positioned directly or indirectly on a ground surface through an opening thereof by a person rolling a wheeled conveyance device carrying said item from the ground surface into said storage compartment such that said person and the wheeled conveyance are simultaneously positioned in the compartment, wherein the storage compartment includes or is associated with an access control system configured to control access to said storage compartment, wherein said storage compartment includes a collapsible storage shelf coupled to a ceiling of said storage compartment, wherein said collapsible shelf, when collapsed, defines or is positioned immediately adjacent to the ceiling of said storage compartment and is oriented parallel to the ceiling, and when expanded defines a sub-compartment within said storage compartment;

moving said collapsible shelf from at least one of the collapsed or expanded position to the other one of the collapsed or expanded position; and providing a code to a user which said user can provide to said access control system to thereby access and remove said item from said storage compartment through said opening.

12. The method of claim 11 wherein said storage compartment includes or is associated with a sensor system configured to detect at least one of a removal, placement, presence, or absence of said item relative to said storage compartment.

13. The method of claim 11 wherein, after said receiving step, a picker locates said item, places said item on or in a wheeled conveyance, rolls said wheeled conveyance into said storage compartment, and secures said wheeled conveyance and said item in said storage compartment.

14. The method of claim 11 wherein said wheeled conveyance device is at a first elevation when positioned directly on a ground surface immediately prior to being rolled into storage compartment, and wherein said wheeled conveyance is at a second elevation after being rolled into said storage compartment, and wherein said first elevation differ from said second elevation by no more than about one inch.

15. The method of claim 11 wherein the receiving of the order is done by a seller of the item, the placing of said item is done by the seller, and the providing step is done by the seller, and wherein said user is a purchaser of said item.

16. The method of claim 11 wherein the placing step includes placing said item into one of a plurality of said storage compartments, and wherein the method further includes providing information relating to which of said storage compartments the item is positioned.

17. An access and storage system comprising:

a generally enclosed storage compartment sized such that a person can entirely enter said compartment to place an item to be dispensed in said storage compartment, wherein said storage compartment includes a collapsible storage shelf configured to be collapsed against a ceiling of said storage compartment;

a sensor system configured to detect at least one of a removal, placement, presence, or absence of said item relative to said storage compartment; and an access control system configured to control access of a user to said storage compartment.

18. The system of claim 17 wherein said storage compartment is directly or indirectly positioned on a ground surface such that a wheeled conveyance device carrying said items is rollable directly into said storage compartment.

19. The system of claim 17 wherein said shelf is directly coupled to said ceiling.

20. The system of claim 17 wherein said storage compartment has an opening sized and positioned such that a wheeled conveyance device carrying the item to be dispensed is rollable from the ground surface through said opening and into said storage compartment.

21. The system of claim 20 wherein the sensor system is configured to detect at least one of a removal of said item from said compartment through said opening or placement of said item in said compartment through said opening.

22. The system of claim 17 wherein said storage compartment has a height of at least about 6 feet.

23. The system of claim 17 further comprising a processor for receiving an order relating to a purchase of said item, and responsive thereto issuing a code to a purchaser, which the purchaser can provide to said access control system to thereby access said storage compartment.

24. The system of claim 17 wherein said system further includes a first door configured to control access to a sub-compartment defined by the collapsible storage shelf when said collapsible storage shelf is expanded, and a second door configured to control access to a remainder of said compartment when said collapsible storage shelf is expanded.

25. The system of claim 17 wherein said collapsible storage shelf, when collapsed, defines or is positioned immediately adjacent to the ceiling of said storage compartment and is oriented parallel to the ceiling, and when expanded defines a sub-compartment within said storage compartment.

26. An access and storage system comprising:

a generally enclosed storage compartment directly or indirectly positioned on a ground surface such that a wheeled conveyance device carrying an item to be dispensed is rollable directly into said storage compartment;

a collapsible storage shelf positioned in said storage compartment, wherein said shelf is configured such that, when collapsed, said shelf defines or is positioned immediately adjacent to a ceiling of said storage compartment, and when expanded defines a sub-compartment within said storage compartment and correspondingly decreases a size of a remainder of said compartment;

a first door configured to control access to said sub-compartment when said collapsible shelf is expanded; and a second door configured to control access to said remainder of said compartment when said collapsible shelf is expanded.

27. An access and storage system comprising:

a generally enclosed storage compartment, said storage compartment having an opening and being configured to be directly or indirectly positioned on a ground surface such that a wheeled conveyance device carrying an item to be dispensed is rollable directly into said storage compartment through said opening, wherein said storage compartment is sized such that a person and said wheeled conveyance can be simultaneously entirely positioned in said compartment, wherein said storage compartment includes a collapsible storage shelf coupled to a ceiling of said storage compartment, wherein said collapsible shelf, when collapsed, defines or is positioned immediately adjacent to the ceiling of said storage compartment and is oriented parallel to the ceiling, and when expanded defines a sub-compartment within said storage compartment; and a sensor system configured to detect at least one of a placement, presence, removal or absence of said item relative to said storage compartment.

28. The system of claim 27 wherein said storage compartment is sized such that a person can entirely enter said compartment through said opening to place said wheeled conveyance and said item into said storage compartment.

29. The system of claim 2 wherein said opening is a single, continuous opening sized such that a person can pass therethrough and enter said storage compartment.

30. The system of claim 27 wherein the sensor system is configured to detect said at least one of said removal or said placement of said item by detecting the presence or absence of said item, or by detecting a movement of said item through said opening.

31. The system of claim 27 wherein the sensor system is configured to detect at least one of a removal of said item from said compartment through said opening or placement of said item in said compartment through said opening.

32. The system of claim 27 wherein the sensor system is configured to detect removal of said item from each compartment through said associated opening or placement of said item in said compartment through said associated opening.

33. The system of claim 27 wherein said storage compartment has a height of at least about 6 feet.

34. The system of claim 27 further comprising an access control system configured to control access to said storage compartment.

35. The system of claim 34 wherein the system includes a plurality of generally enclosed storage compartments that are positioned immediately adjacent to each other, and wherein the access control system is configured to control access to each storage compartment of the storage compartments.

36. The system of claim 34 wherein the system includes a plurality of generally enclosed storage compartments that are positioned at or in the same retail store, and wherein the access control system is configured to control access to each storage compartment at the retail store.

* * * * *